US007294024B2

(12) United States Patent
Hammond, Jr. et al.

(10) Patent No.: US 7,294,024 B2
(45) Date of Patent: Nov. 13, 2007

(54) METHODS AND SYSTEMS FOR MINIMIZING ALIEN CROSSTALK BETWEEN CONNECTORS

(75) Inventors: Bernard Harold Hammond, Jr., Aurora, CO (US); Damon F. DeBenedictis, Castle Rock, CO (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 11/327,296

(22) Filed: Jan. 6, 2006

(65) Prior Publication Data

US 2007/0161295 A1 Jul. 12, 2007

(51) Int. Cl.
*H01R 24/00* (2006.01)

(52) U.S. Cl. ..... 439/676; 439/608

(58) Field of Classification Search ..... 439/676, 439/607, 941

See application file for complete search history.

(56) References Cited

U.S. PATENT DOCUMENTS

| | | | | |
|---|---|---|---|---|
| 1,689,358 | A | | 10/1928 | Miller |
| 3,744,128 | A | | 7/1973 | Fisher et al. |
| 4,324,449 | A | | 4/1982 | Watanabe et al. |
| 4,399,487 | A | | 8/1983 | Neumann |
| 4,519,664 | A | * | 5/1985 | Tillotson ..... 439/607 |
| 4,557,545 | A | | 12/1985 | Ohtsuki et al. |
| 4,756,695 | A | * | 7/1988 | Lane et al. ..... 439/76.1 |
| 4,820,196 | A | | 4/1989 | Roselle et al. |
| 4,850,887 | A | | 7/1989 | Sugawara |
| 4,981,451 | A | | 1/1991 | Undin et al. |
| 5,085,590 | A | | 2/1992 | Galloway |
| 5,092,785 | A | * | 3/1992 | Chen ..... 439/188 |
| 5,096,442 | A | * | 3/1992 | Arnett et al. ..... 439/676 |
| 5,125,854 | A | | 6/1992 | Bassler et al. |
| 5,160,273 | A | | 11/1992 | Carney |
| 5,161,997 | A | | 11/1992 | Defibaugh et al. |
| 5,228,872 | A | | 7/1993 | Liu |

(Continued)

FOREIGN PATENT DOCUMENTS

EP 0 598 614 A2 5/1994

(Continued)

OTHER PUBLICATIONS

Erni Companies, MJH Series: (.498 Height) Non-Shielded, Partially Shielded, Catalog MCMJ74a, May 2003, Edition 2, www.erni.com.

*Primary Examiner*—James R. Harvey
*Assistant Examiner*—Travis Chamebrs
(74) *Attorney, Agent, or Firm*—Merchant & Gould P.C.

(57) ABSTRACT

A telecommunications device comprising a faceplate including at least two adjacent jack receptacles, the two adjacent jack receptacles positioned vertically and horizontally offset to each other and a jack mounted in at least one of the two jack receptacles, the jack defining a port in the front end for receiving a plug, the jack also defining spring contacts within the port for making electrical contact with the plug, the jack including insulation displacement contacts electrically connected to the spring contacts, the insulation displacement contacts configured to establish electrical contact with conductors of a cable. A cap manufactured of a material configured to minimize transmission of electrical signal away from its intended path fits about the jack to cover at least a portion of the outer surface defined by the insulation displacement contacts.

18 Claims, 13 Drawing Sheets

U.S. PATENT DOCUMENTS 5,246,391 A 9/1993 Seidler
5,267,868 A 12/1993 Wolff, Jr.
5,362,254 A 11/1994 Siemon et al.
5,429,528 A 7/1995 Longueville et al.
5,443,390 A 8/1995 Kokkosoulis et al.
5,443,392 A 8/1995 Longueville et al.
5,480,326 A 1/1996 Chen
5,496,195 A 3/1996 Reed
5,531,612 A 7/1996 Goodall et al.
5,562,507 A 10/1996 Kan
5,599,206 A 2/1997 Slack et al.
5,639,267 A 6/1997 Loudermilk
5,645,449 A 7/1997 Sabo
5,685,740 A 11/1997 Lim
5,700,167 A 12/1997 Pharney et al.
5,741,158 A 4/1998 Reed et al.
5,773,763 A 6/1998 Stachulla
5,775,946 A 7/1998 Briones
5,879,199 A 3/1999 Belopolsky
5,934,940 A 8/1999 Maranto et al.
5,961,350 A 10/1999 Shiu
6,036,547 A 3/2000 Belopolsky et al.
6,057,743 A 5/2000 Aekins
6,068,520 A 5/2000 Winings et al.
6,080,011 A 6/2000 Tsao et al.
6,123,577 A 9/2000 Contois et al.
6,129,587 A 10/2000 Huang
6,132,260 A 10/2000 Wu
6,151,392 A 11/2000 Castonguay et al.
6,174,202 B1 1/2001 Mitra
6,183,307 B1 2/2001 Laity et al.
6,193,560 B1 2/2001 Morana et al.
6,206,725 B1 3/2001 Wu
6,210,237 B1 4/2001 Chang
6,227,911 B1 5/2001 Boutros et al.
6,234,832 B1 5/2001 Belopolsky et al.
6,250,964 B1 6/2001 Fair et al.
6,267,628 B1 7/2001 Meckley et al.
6,280,256 B1 8/2001 Belopolsky et al.
6,290,535 B1 9/2001 Lin et al.
6,299,480 B1 10/2001 Xu et al.
6,325,634 B1 * 12/2001 Daoud et al. ..... 439/49
6,328,602 B1 12/2001 Yamasaki et al.
6,366,671 B1 4/2002 Beavers
6,373,944 B1 4/2002 Beavers
6,379,185 B2 4/2002 Belopolsky et al.
6,413,120 B1 7/2002 Winings et al.
6,419,526 B1 7/2002 Fair et al.
6,478,621 B2 11/2002 Ma et al.
6,488,533 B1 * 12/2002 Thompson et al. ..... 439/509
6,568,959 B1 5/2003 Lo
6,629,858 B2 10/2003 Lo et al.
6,655,988 B1 12/2003 Simmons et al.
6,746,283 B2 6/2004 Arnett et al.
6,793,524 B2 9/2004 Clark et al.
6,807,068 B1 10/2004 Sangree et al.
6,811,438 B1 11/2004 Ko
6,896,541 B2 * 5/2005 Benson ..... 439/489
6,902,416 B2 6/2005 Feldman
6,905,367 B2 6/2005 Crane et al.
2001/0004567 A1 6/2001 Chen et al.
2001/0005653 A1 6/2001 Belopolsky
2001/0018295 A1 8/2001 Fasold et al.
2002/0031954 A1 3/2002 Hess et al.
2002/0031955 A1 3/2002 Schmidt et al.
2002/0045387 A1 4/2002 Schmidt et al.
2002/0055303 A1 5/2002 Belopolsky et al.
2002/0068484 A1 6/2002 Gutierrez et al.
2002/0090862 A1 7/2002 Berstein et al.
2002/0119702 A1 8/2002 Chen
2003/0087558 A1 5/2003 Korsunsky et al.
2003/0087559 A1 5/2003 Korsunsky et al.
2003/0100225 A1 5/2003 Aeschbacher et al.
2003/0129871 A1 7/2003 Follingstad
2003/0129877 A1 7/2003 Chen
2003/0157842 A1 8/2003 Arnett et al.
2003/0186586 A1 10/2003 Gutierrez et al.
2005/0186838 A1 8/2005 Debenedictis et al.
2005/0186844 A1 * 8/2005 Hammond et al. ..... 439/608
2005/0221677 A1 10/2005 Hammond, Jr. et al.
2006/0134995 A1 6/2006 Bolouri-Saransar et al.

FOREIGN PATENT DOCUMENTS

EP 0800238 B1 10/1997
EP 1084523 B1 3/2001
EP 0 887 893 11/2002
EP 1 317 023 A2 6/2003
JP 05063387 A 3/1993
WO WO9602962 A1 2/1996
WO WO97/43804 11/1997
WO WO99/19944 4/1999
WO WO 02/15339 2/2002

* cited by examiner

METHODS AND SYSTEMS FOR MINIMIZING ALIEN CROSSTALK BETWEEN CONNECTORS

TECHNICAL FIELD

The principles disclosed herein relate generally to methods and systems for minimizing alien crosstalk between connectors. Specifically, the methods and systems relate to connector positioning and shielding techniques for minimizing alien crosstalk between connectors used with high-speed data cabling.

BACKGROUND

In the field of data communications, communications networks typically utilize techniques designed to maintain or improve the integrity of signals being transmitted via the network ("transmission signals"). To protect signal integrity, the communications networks should, at a minimum, satisfy compliance standards that are established by standards committees, such as the Institute of Electrical and Electronics Engineers (IEEE). The compliance standards help network designers provide communications networks that achieve at least minimum levels of signal integrity as well as some standard of interoperability.

One obstacle to maintaining adequate levels of signal integrity, known as crosstalk, adversely affects signal integrity by causing capacitive and inductive coupling between the transmission signals. Specifically, electromagnetic interference produced by one transmission signal may couple to another transmission signal and thereby disrupt or interfere with the affected transmission signal. The electromagnetic interference tends to emanate outwardly from a source transmission signal and undesirably affect any sufficiently proximate transmission signal. As a result, crosstalk tends to compromise signal integrity.

The effects of crosstalk increase when transmission signals are more proximate to one another. Consequently, typical communications networks include areas that are especially susceptible to crosstalk because of the proximity of the transmission signals. In particular, the communications networks include connectors that bring transmission signals into close proximity to one another. For example, the conductive pins of a traditional connector, such as a jack, are placed proximate to one another to form a convenient connection configuration, usually within the compact spaces of the connector. While such compact pin arrangements may be physically economical as a convenient connecting medium, the same pin arrangements tend to produce an unacceptable amount of crosstalk between the pins.

Due to the susceptibility of traditional connectors to crosstalk, conventional communications networks have employed a number of techniques to protect the transmission signals against crosstalk within the connector. For example, different arrangements or orientations of the connector pins have been used to reduce pin-to-pin crosstalk. Another known technique includes connecting the pins to conductive elements that are relationally shaped or positioned to induce coupling that tends to compensate for the crosstalk between the pins. Another compensation technique involves connecting the pins of a connector to conductive elements of a printed circuit board (PCB), with the conductive elements being relationally positioned or shaped to cause compensational coupling between them.

Intra-connector techniques for combating crosstalk, such as those described above, have helped to satisfactorily maintain the signal integrity of traditional transmission signals. However, with the widespread and growing use of computers in communications applications, the ensuing volumes of data traffic have accentuated the need for communications networks to transmit the data at higher speeds. When the data is transmitted at higher speeds, signal integrity is more easily compromised due to increased levels of interference between the high-speed transmission signals carrying the data. In particular, the effects of crosstalk are magnified because the high-speed signals produce stronger electromagnetic interference levels as well as increased coupling distances.

The magnified crosstalk associated with high-speed signals can significantly disrupt the transmission signals of conventional network connectors. Of special concern is one form of crosstalk that traditional connectors were able to overlook or ignore when transmitting traditional data signals. This form of crosstalk, known as alien crosstalk, describes the coupling effects between connectors. For example, high-speed data signals traveling via a first connector produce electromagnetic interference that couples to high-speed data signals traveling via an adjacent connector, adversely affecting the high-speed data signals of the adjacent jack. The magnified alien crosstalk produced by the high-speed signals can easily compromise the integrity of the transmission signals of an adjacent connector. Consequently, the transmission signals may become unrecognizable to a receiving device, and may even be compromised to the point that the transmission signals no longer comply with the established compliance standards.

Conventional connectors are ill-equipped to protect high-speed signals from alien crosstalk. Conventional connectors have largely been able to ignore alien crosstalk when transmitting traditional data signals. Instead, conventional connectors utilize techniques designed to control intra-connector crosstalk. However, these techniques do not provide adequate levels of isolation or compensation to protect from connector-to-connector alien crosstalk at high transmission speeds. Moreover, such techniques cannot be applied to alien crosstalk, which can be much more complicated to compensate for than is intra-connector crosstalk. In particular, alien crosstalk comes from a number of unpredictable sources, especially in the context of high-speed signals that typically use more transmission signals to carry the signal's increased bandwidth requirements. For example, traditional transmission signals such as 10 megabits per second and 100 megabits per second Ethernet signals typically use only two pin pairs for propagation through conventional connectors. However, higher speed signals require increased bandwidth. Accordingly, high-speed signals, such as 1 gigabit per second and 10 gigabits per second Ethernet signals, are usually transmitted in full-duplex mode (2-way transmission over a pin pair) over more than two pin pairs, thereby increasing the number of sources of crosstalk. Consequently, the known intra-connector techniques of conventional connectors cannot predict or overcome alien crosstalk produced by high-speed signals.

Although other types of connectors have achieved levels of isolation that may combat the alien crosstalk produced by high-speed transmission signals, these types of connectors have shortcomings that make their use undesirable in many communications systems, such as LAN communities. For example, shielded connectors exist that may achieve adequate levels of isolation to protect high-speed signal integrity, but these types of shielded connectors typically use a ground connection or can be used only with shielded cabling, which costs considerably more than unshielded cabling. Unshielded systems typically enjoy significant cost savings, which savings increase the desirability of unshielded systems as a transmitting medium. Moreover, conventional unshielded twisted pair cables are already well-established in a substantial number of existing communications systems. Further, inasmuch as ground connections may become faulty, shielded network systems run the risk of the ungrounded shields acting as antennae for electromagnetic interference.

In short, alien crosstalk is a significant factor for protecting the signal integrity of high-speed signals being transmitted via data communications networks. Conventional network connectors cannot effectively and accurately transmit high-speed data signals. Specifically, the conventional connectors for use in unshielded cabling networks do not provide adequate levels of isolation from alien crosstalk.

SUMMARY

The present invention relates to methods and systems for minimizing alien crosstalk between connectors/jacks. Specifically, the methods and systems relate to isolation techniques for minimizing alien crosstalk between connectors for use with high-speed data cabling. A telecommunications device including a faceplate can be configured to receive a number of jacks. A number of shield structures such as termination caps may be positioned on the jacks to isolate at least a subset of the jacks from one another and to reduce alien crosstalk between the jacks. The jacks can also be positioned to move at least a subset of the jacks away from alignment within a common plane to minimize alien crosstalk.

BRIEF DESCRIPTION OF THE DRAWINGS

Certain embodiments of present methods and systems will now be described, by way of examples, with reference to the accompanying drawings, in which.

DETAILED DESCRIPTION

Figure 1:
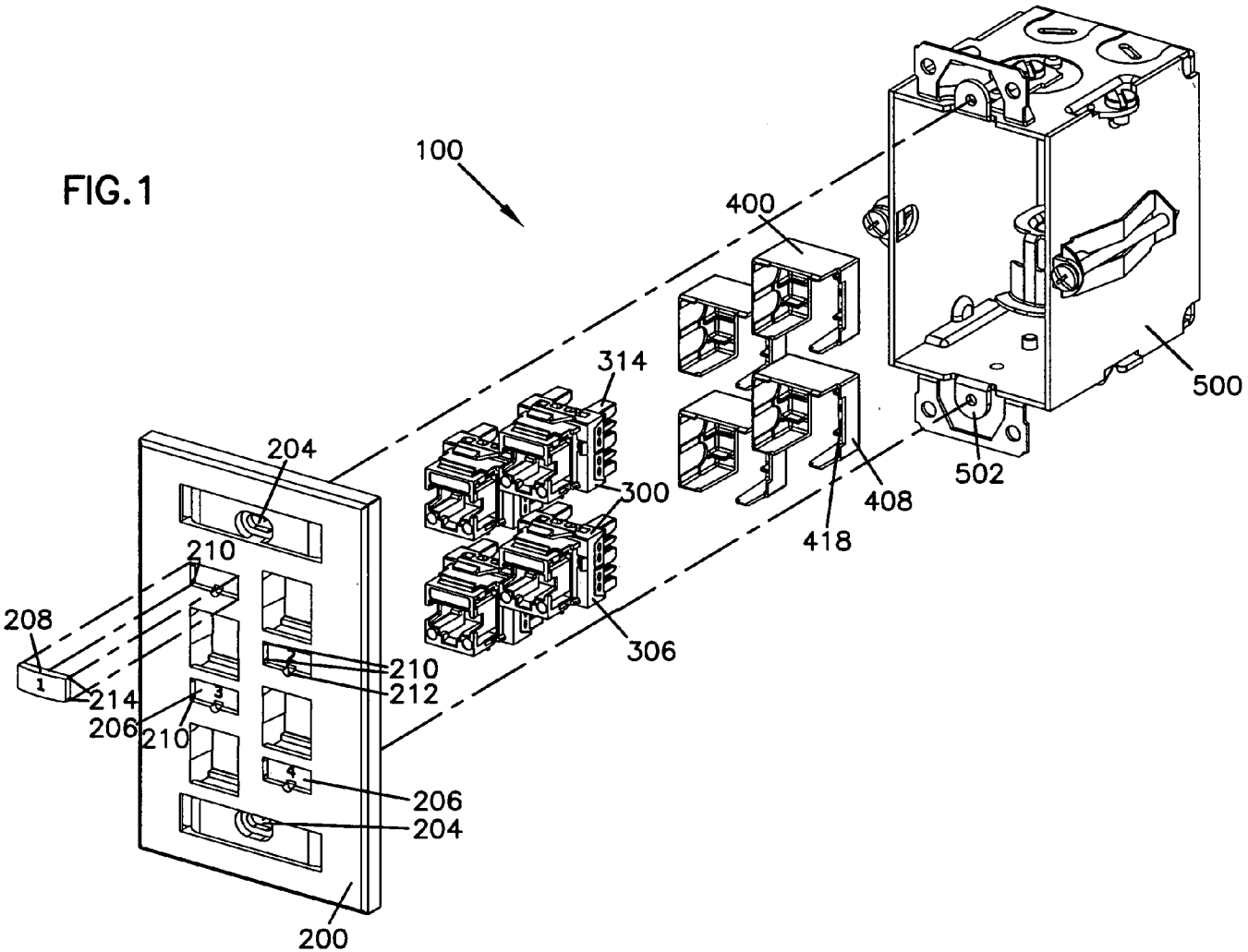
FIG. 1 is an exploded front perspective view of a telecommunications device having features that are examples of inventive aspects in accordance with the principles of the present disclosure.
Figure 2:
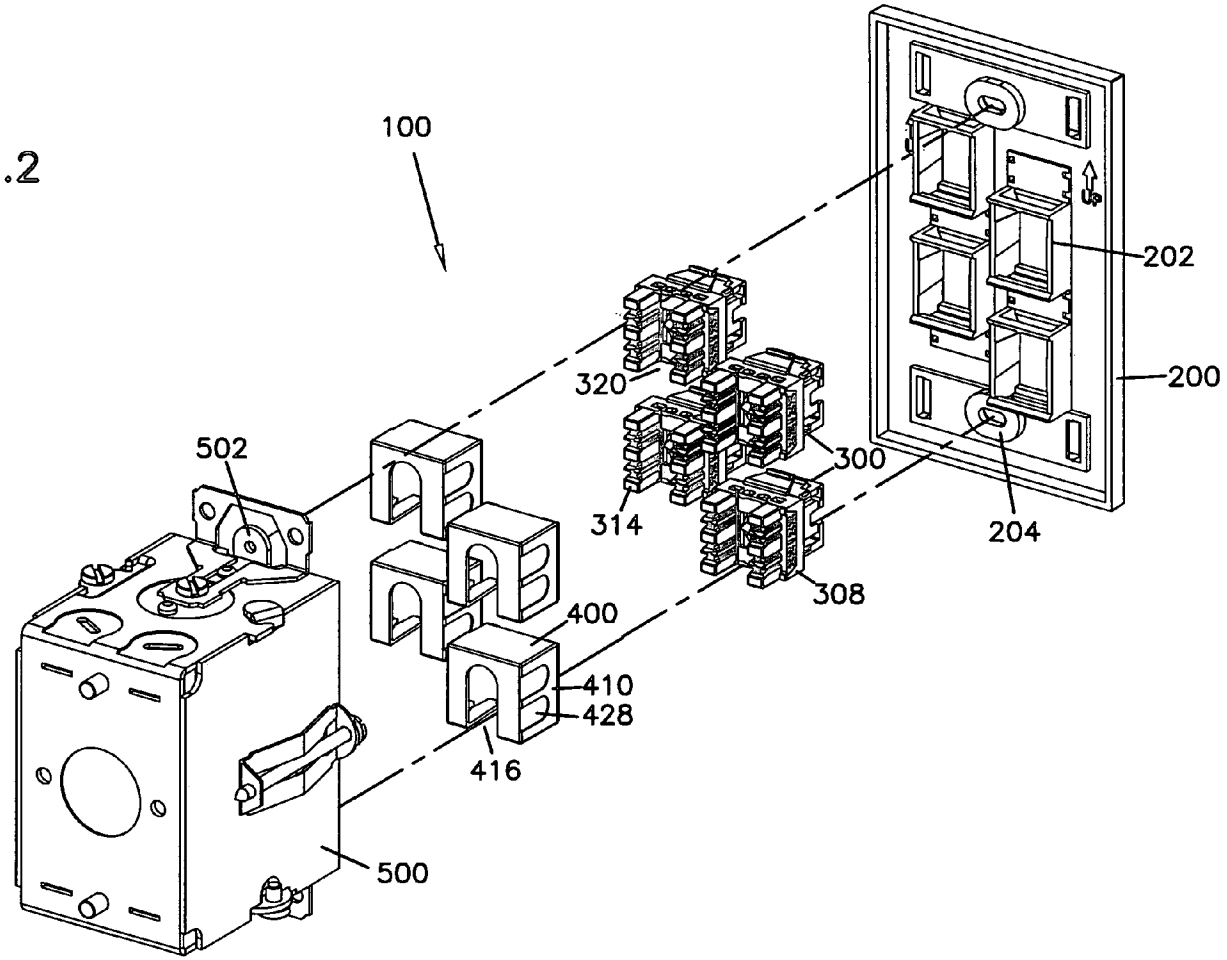
FIG. 2 is an exploded rear perspective view of the telecommunications device of FIG. 1.

The inventive aspects of the present disclosure relate to methods and systems for minimizing alien crosstalk between connectors. Specifically, the methods and systems relate to isolation techniques for minimizing alien crosstalk between connectors for use with high-speed data cabling.

Throughout the detailed description and the claims, the terms "connector" and "jack" may be used interchangeably to refer to the same feature.

Referring to FIGS. 1–4, there is illustrated a telecommunications device 100 having features that are examples of inventive aspects in accordance with the principles of the present disclosure. The telecommunications device 100 includes a faceplate 200, a plurality of jacks 300 configured to be mounted on the faceplate 200, a plurality of termination caps 400 that are configured to be mounted on the jacks 300, and an electrical outlet box 500 to which the faceplate 200 can be mounted to enclose the jacks 300.

Figure 4:
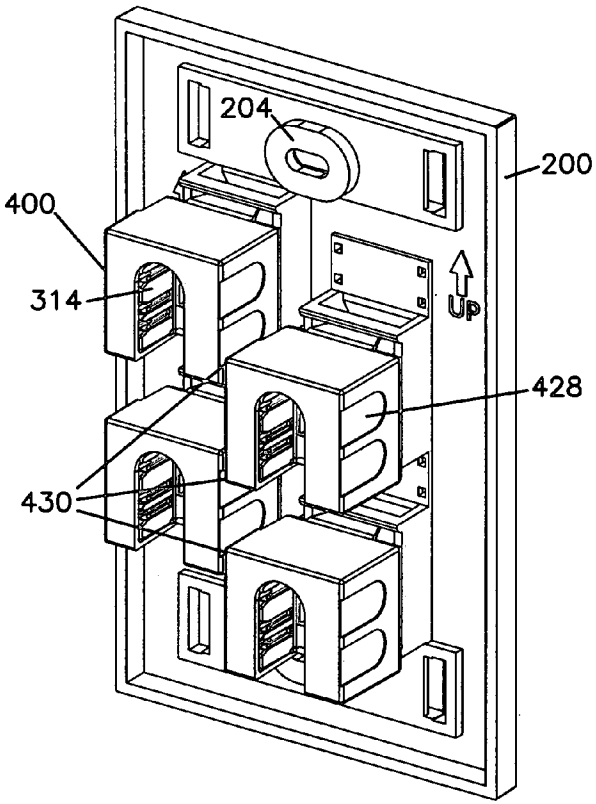
FIG. 4 is a rear perspective view of the faceplate, the jacks, and the termination caps of FIG. 3.
Figure 3:
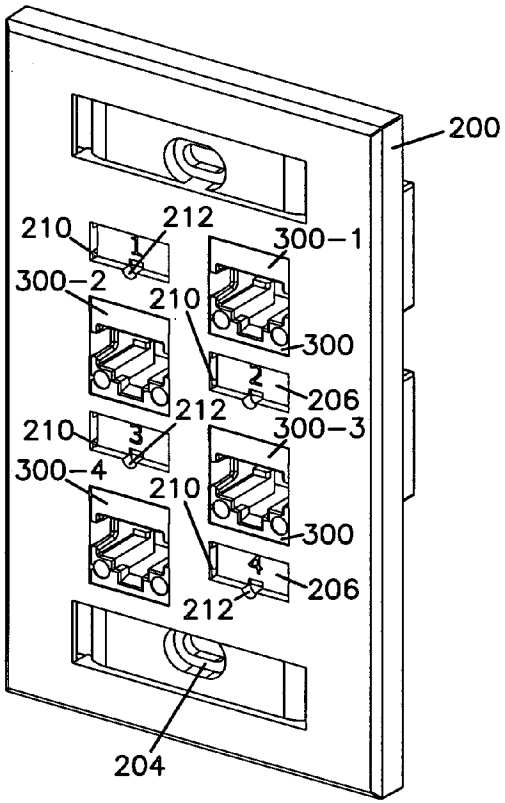
FIG. 3 is a front perspective view showing the jacks and the terminations caps mounted on the faceplate of the telecommunications device of FIG. 1.

The jacks 300 and the termination caps are shown mounted on the faceplate 200 of the telecommunications device 100 in FIGS. 3 and 4. The jacks 300 are snap-fit into the jack receptacles 202 of the faceplate 200 and the termination caps 400 are mounted on the insulation displacement contact (IDC) housings of the jacks 300. Once the jacks 300 and the caps 400 are coupled to the faceplate 200, mounting structures 204 of the faceplate can be fastened to mounting structures 502 of the outlet box 500 via fasteners (not shown) to mount the faceplate 200 to the outlet box 500 (see FIGS. 1 and 2).

Figure 6:
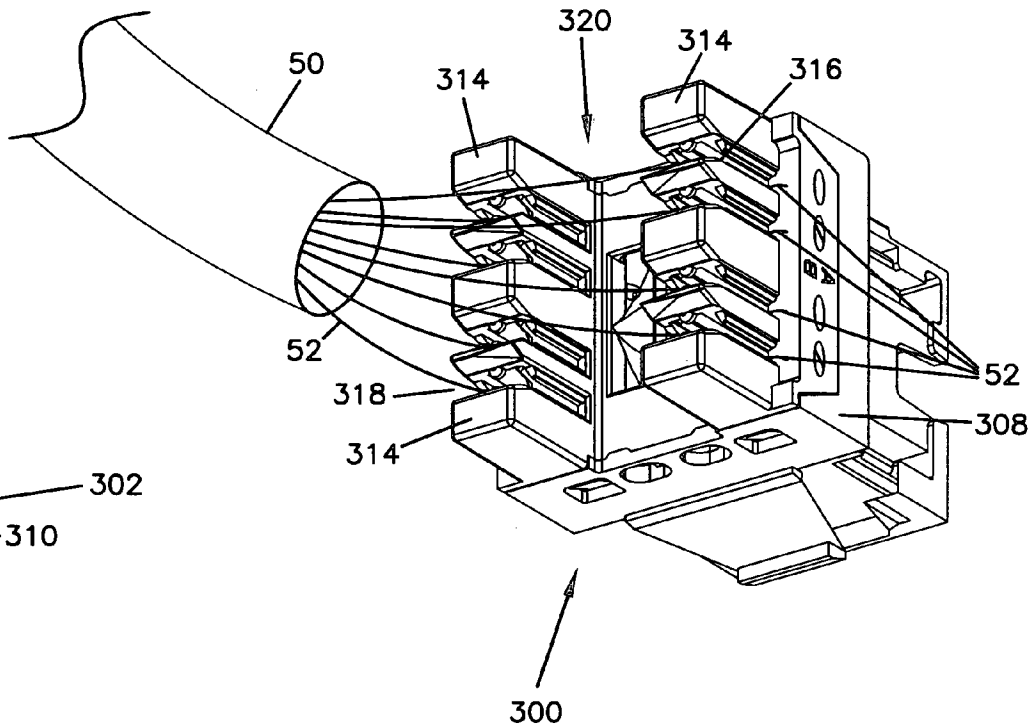
FIG. 6 is a rear perspective view of the jack of FIG. 5, the jack shown terminated to a cable.
Figure 5:
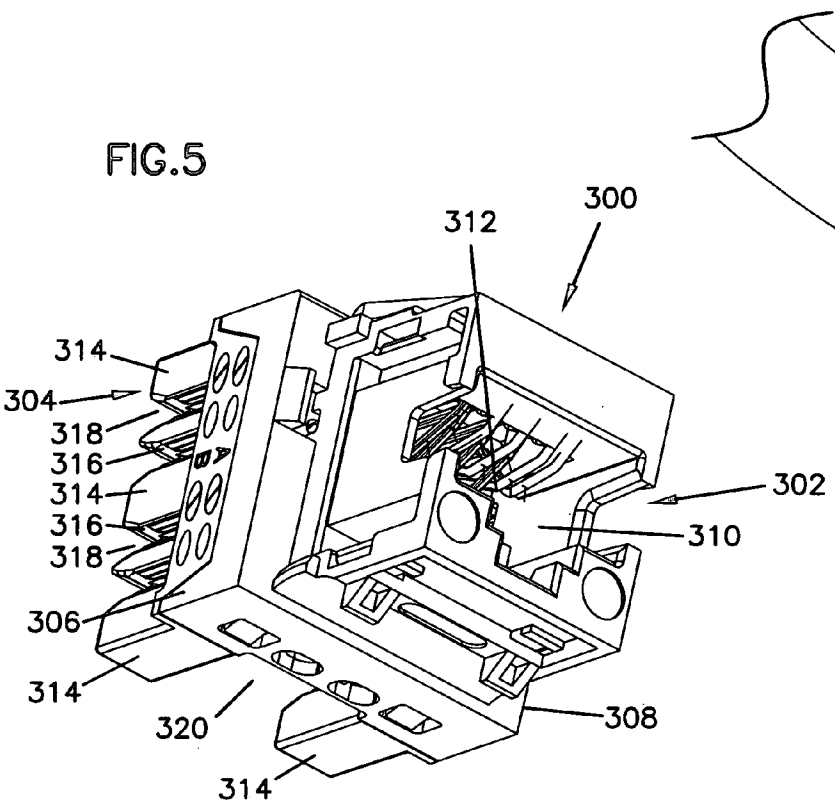
FIG. 5 is a front perspective view of a jack of the telecommunications device of FIG. 1.
Figure 9:
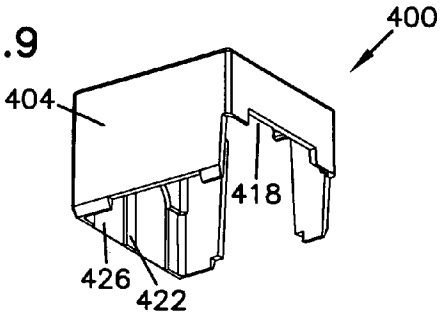
FIG. 9 is a top, front, right side perspective view of the termination cap of FIG. 7.
Figure 12:
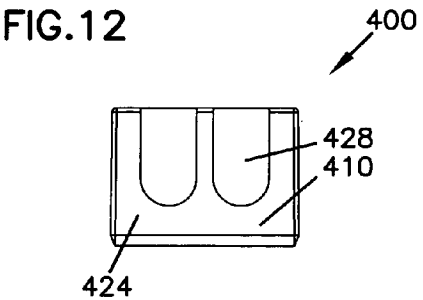
FIG. 12 is a left side view of the termination cap of FIG. 7.
Figure 15:
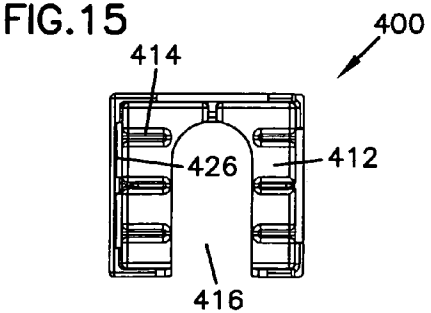
FIG. 15 is a front view of the termination cap of FIG. 7.
Figure 8:
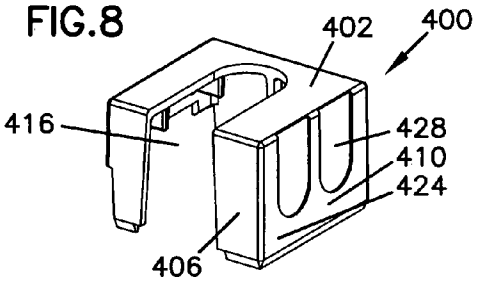
FIG. 8 is a bottom, rear, left side perspective view of the termination cap of FIG. 7.
Figure 11:
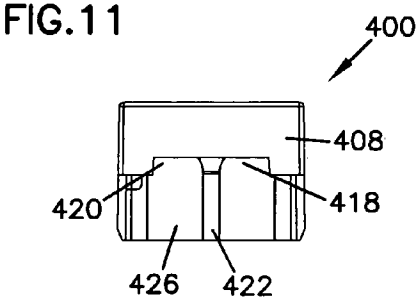
FIG. 11 is a right side view of the termination cap of FIG. 7.
Figure 14:
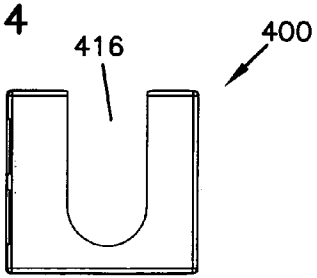
FIG. 14 is a rear view of the termination cap of FIG. 7.
Figure 7:
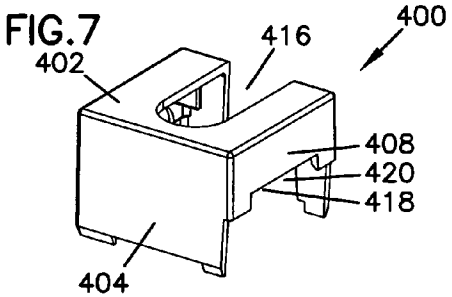
FIG. 7 is a top, rear, right side perspective view of a termination cap of the telecommunications device of FIG. 1.
Figure 10:
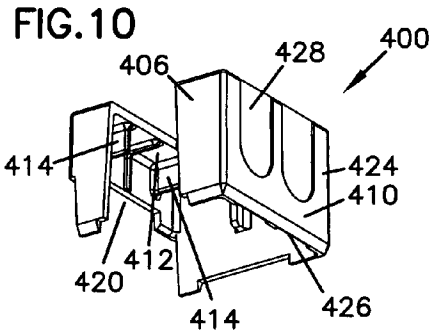
FIG. 10 is a bottom, front, left side perspective view of the termination cap of FIG. 7.
Figure 13:
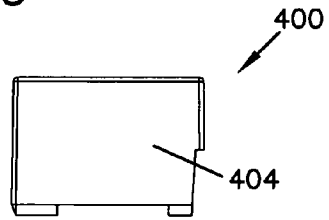
FIG. 13 is a top view of the termination cap of FIG. 7.

One of the jacks (i.e., connectors) 300 is shown in FIGS. 5 and 6. The jack 300 includes a front end 302, a back end 304, a first outermost sidewall 306 and an opposite second outermost sidewall 308. The jack 300 defines a port 310 (i.e., socket) in the front end 302 for receiving a plug (not shown) and also defines spring contacts 312 within the port 310 for making electrical contact with the plug. The jack 300 includes IDC housings 314 which house IDC's 316. The IDC's 316 are configured to receive and establish electrical contact with insulated conductors 52 of a cable 50 (see FIGS. 6 and 16) that is terminated to the jack 300. The jack 300 includes structure (e.g., a printed circuit board) that electrically connects the IDC's 316 to the spring contacts 312. Thus, the jack 300 provides the medium for establishing an electrical connection between the conductors 52 received by the IDC's 316 and a plug inserted into the port 310. In some embodiments, the jack 300 may comprise a recommended jack (RJ), such as an RJ-45 or RJ-48 type jack.

Now referring to FIGS. 7–15, one of the termination caps 400 of the telecommunications device 100 that is constructed for use with the jacks 300 is shown.

The termination cap 400 comprises conductive material that functions to obstruct or minimize the flow of electrical signals away from their intended paths, including the coupling signals of alien crosstalk. In other words, the conductive material of the termination cap 400 acts as an electrical barrier between jacks 300 that are mounted adjacent to each other on a piece of telecommunications equipment such as a faceplate.

The conductive material of the termination cap 400 can comprise any material that helps to minimize alien crosstalk. The material may include any conductive material, including but not limited to nickel, copper, and conductive paints, inks, and, sprays. In certain embodiments, the termination cap 400 can include a metal-based structure or may include a spray-on coating of conductive material applied to a non-conductive supporting material, such as some type of a polymer.

In certain embodiments, the termination caps 400 may be constructed to include conductive elements that disrupt alien crosstalk without making the termination cap 400 overall electrically conductive. For example, the termination cap 400 can include a non-conductive supporting material, such as a polymer (e.g., resinous or plastic material) which is impregnated with conductive elements. The conductive elements may include but are not limited to conductive carbon loads, stainless steel fibers, micro-spheres, and plated beads. The conductive elements are preferably positioned such that the termination cap 400, overall, is not conductive. This helps prevent any undesirable short-circuiting as will be discussed in further detail below. However, the conductive elements should be positioned with sufficient density to disrupt alien crosstalk between adjacent jacks 300.

Preferably, the conductive material of the termination cap 400 is not grounded. An ungrounded conductive cap can function to block or at least disrupt alien crosstalk signals. Further, unlike lengthy shields used with shielded cabling, the conductive materials of the termination cap can be sized such that they do not produce harmful capacitances when not grounded. By being able to function without being grounded, the termination cap 400 can isolate adjacent jacks 300 of unshielded cabling systems, which make up a substantial part of deployed cabling systems. Consequently, the termination cap 400 is able to avoid many of the costs, dangers, and hassles that are inherent to a shielded cabling system, including the potentially hazardous effects of a faulty ground connection. In other embodiments, the cap could be used in shielded systems.

Figure 16:
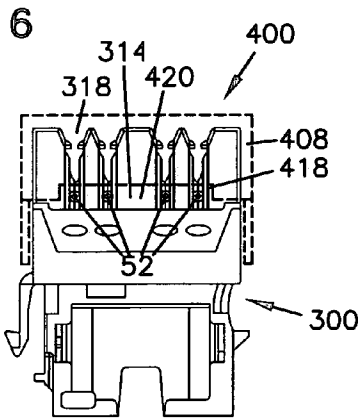
FIG. 16 shows a side view of the jack of FIG. 5 with conductors of a cable terminated to the jack, the jack including the termination cap of FIG. 7 mounted thereon, the termination cap shown in phantom.

The cap 400 is mounted on the IDC housings 314 of the jack 300 to shield the IDC's 316 of the jack 300 from surrounding jacks (see FIGS. 4 and 16). The cap 400 includes a back wall 402, a top wall 404, a bottom wall 406, a first sidewall 408, and a second sidewall 410. The inner side 412 of the back wall 402 defines projections 414 that frictionally fit into the gaps 318 (see FIGS. 5 and 6) defined by the IDC housings 314 to couple the cap 400 to the jack 300. The configuration of the cap 400 allows the cap to be mounted onto the jack in either of two orientations 180 degrees apart. The back wall 402 and the bottom wall 406 of the cap 400 cooperatively define an opening 416 that is generally aligned with the space 320 in between the two columns of IDC housings 314 of the jack 300.

The opening 416 of the termination cap 400 accommodates a cable 50 that is terminated to the jack 300. The conductors 52 of the cable 50 are terminated to the IDC's 316 that are exposed within the gaps 318 defined by the IDC housings 314 (see FIGS. 6 and 16). The opening 416 allows the cap 400 to be mounted to or removed from the jack 300 without having to disconnect the cable 50 from the jack 300. The conductors 52 of a cable 50 are press fit into the IDC's 316 of the jack 300. Once terminated to the jack, the portion of the conductors 52 that extend laterally out of the IDC housings 314 can be trimmed close to the first and second outermost sidewalls 306, 308 with an installation tool.

Figure 17:
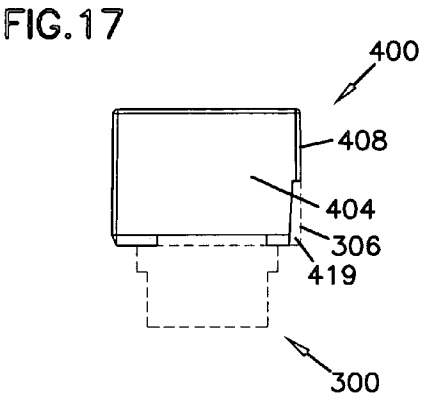
FIG. 17 is a top view of the termination cap of FIG. 7 mounted on the jack of FIG. 5, the jack shown in phantom.

Still referring to FIGS. 7–15, the cap 400 is constructed such that, once mounted on the jack 300, the first sidewall 408 of the cap 400 has an outer surface that aligns flush with the first outermost sidewall 306 of the jack 300 (see FIG. 17). The first sidewall 408 of the cap 400 includes a notch 418 that defines airspace 420 between the first sidewall 408 of the cap 400 and the first outermost sidewall 306 of the jack 300 when the cap 400 is mounted on the jack 300 (see FIGS. 9, 11, and 16). The airspace 420 is for accommodating the ends of the conductors 52 of the cable 50 that extend out from the sides of the IDC housings 314. The notch 418 allows the ends of the conductors 52 to protrude out without contacting the conductive elements of the cap 400 and creating a short. Thus, even if the conductors 52 of the cable 50 protrude out from the sides of the IDC housings 314, the first sidewall 408 of the cap 400 can be mounted flush with the outermost sidewall 306 of the jack 300, decreasing the overall width of the jack 300, even with the termination cap 400 mounted on. As seen in FIG. 17, a second notch 419 is defined between the first outer sidewall 306 of the jack and the first sidewall 408 of the cap, the notch 419 being visible from the top and bottom views of the cap 400.

The second sidewall 410 of the cap 400 (see FIGS. 8, 10, and 12), unlike the first sidewall 408, extends laterally past the second outermost sidewall 308 of the jack 300 and covers the entire height of the IDC housings 314. When two caps 400 are mounted on two adjacent jacks 300, they are preferably mounted such that the second sidewall 410 of one cap 400 is adjacent to and opposes the first sidewall 408 of an adjacent cap 400. In this manner, since the first sidewall 408 of one cap 400 leaves airspace 420 exposing a portion of the IDC's of the jack, the second sidewall 410 of the adjacent cap can shield the entire height of the IDC housings 314 of the adjacent jack and reduce the amount of exposure in between two adjacent jacks 300. The design of the caps 400 allows two adjacent jacks to both receive caps since the first sidewall 408 of the cap does not extend beyond the outermost sidewall 306 of the jack and leaves enough room for another cap to be mounted on an adjacent jack. In this manner, full shielding can be provided between two adjacent jacks 300 that are mounted on a faceplate that fits a standard electrical outlet box 500 (see FIGS. 1–2).

Figure 19:
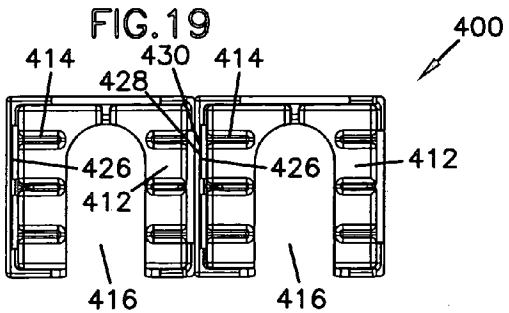
FIG. 19 is a front view of two of the termination caps of FIG. 7 mounted adjacent to each other.
Figure 18:
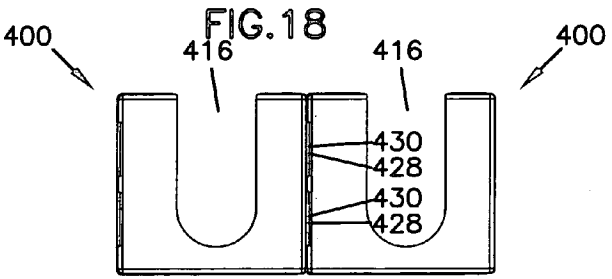
FIG. 18 is a rear view of two of the termination caps of FIG. 7 mounted adjacent to each other.

The second sidewall 410 of the cap 400 defines an inner surface 422 and outer surface 424. The cap 400 defines recesses 426 on the inner surface 422 and recesses 428 on the outer surface 424. The recesses 428 on the outer surface 424 are provided to leave an air pocket 430 in between two adjacent jacks when both of the jacks 300 have caps 400 mounted thereon (see FIGS. 4 and 18). This provides clearance space for cut ends of conductors 52 that protrude through notch 418 of an adjacent jack cap (see a rear view of two adjacent caps in FIG. 18 and see a front view of two adjacent caps in FIG. 19). In this manner, two adjacent jacks that are next to each other in close proximity can receive termination caps 400. It should be noted that the recesses 428 on the outer surface 424 of the cap 400 are not visible when the cap is directly viewed from the front view as in FIGS. 15 and 19 (recesses are shown in phantom in FIG. 19 for illustration purposes). Only recesses 426 on the inner surface 422 are visible when the cap 400 is viewed from a front view as in FIGS. 15 and 19.

The recesses 426 in the inner surface 422 are designed to leave a gap for the ends of the conductors 52 of the cable 50 that extend out from the side 308 of the IDC housings 314 so that a short is not created by contact.

In addition to the crosstalk reduction provided by the shielded termination caps 400, alien crosstalk between the jacks 300 can be minimized by selectively positioning the jacks 300 so that they are not aligned with one another. Again, adjacent jacks 300 are of particular concern. When conductors (i.e., spring contacts, IDC's) of a first adjacent jack 300 are aligned with the conductors of a second adjacent jack 300, the adjacent jacks 300 are more prone to the coupling effects of alien crosstalk. Accordingly, alien crosstalk can be reduced by positioning the adjacent jacks 300 such that the conductors of one jack 300 are not aligned with the conductors of an adjacent jack 300. Preferably, the adjacent jacks 300 are moved away from an aligned position such that the number of adjacent jacks 300 within a common plane is minimized. This helps to reduce alien crosstalk between the adjacent jacks 300. The adjacent jacks 300 can be moved away from being aligned in a wide variety of ways, including staggering and offsetting.

Figure 20:
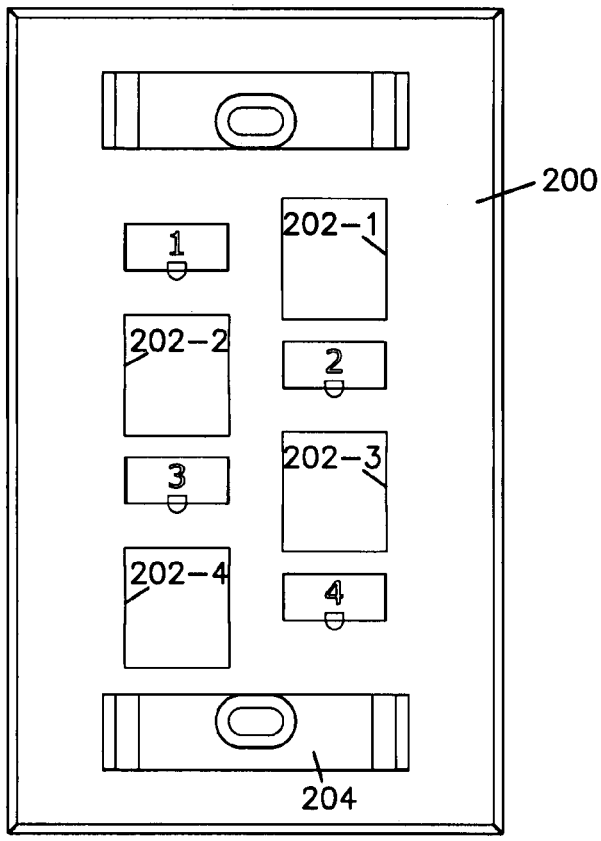
FIG. 20 is a front elevational view of a faceplate of the telecommunications device of FIG. 1.
Figure 21:
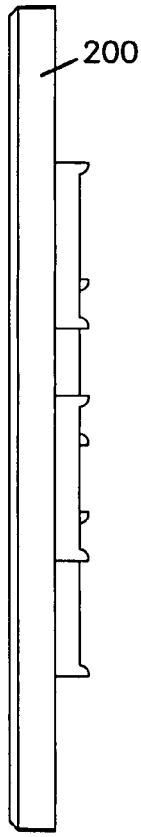
FIG. 21 is a side elevational view of the faceplate of FIG. 20.
Figure 22:
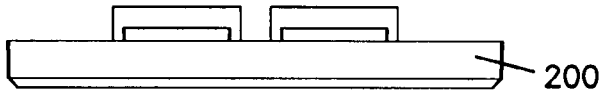
FIG. 22 is a top plan view of the faceplate of FIG. 20.

The faceplate 200 of the telecommunications device 100, shown in FIGS. 20–22 utilizes offsetting to provide for crosstalk reduction. The faceplate 200 includes a first jack receptacle 202-1, an adjacent second jack receptacle 202-2, a third jack receptacle 202-3 and an adjacent fourth jack receptacle 202-4. The adjacent receptacle pairs 202 of the faceplate 200 are both horizontally and vertically offset with respect to each other. By vertically and horizontally offsetting two adjacent jacks 300, the distance between the conductors of two adjacent jacks can be increased.

An offset configuration of the jacks 300 helps minimize alien crosstalk between the adjacent jacks 300 by moving the spring contacts 312 and/or IDC's 316 of the jacks 300 away from alignment and by maximizing spacing between conductors of adjacent jacks within a given footprint. For example, in the embodiment of the faceplate 200, two adjacent jacks 300 are offset so that one adjacent jack 300 is not directly above, below, or to the side of an adjacent jack 300. A similar faceplate design is described in commonly owned U.S. Patent Application Publication No. 2005/0186838, the disclosure of which is hereby incorporated by reference.

Figure 23:
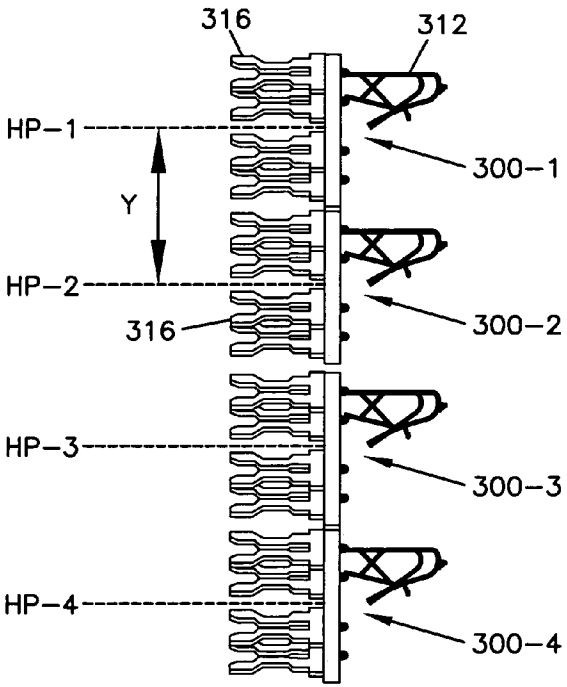
FIG. 23 is a diagrammatical side view showing the arrangement of the conductors of the jacks when the jacks are mounted on the faceplate of FIG. 20.
Figure 25:
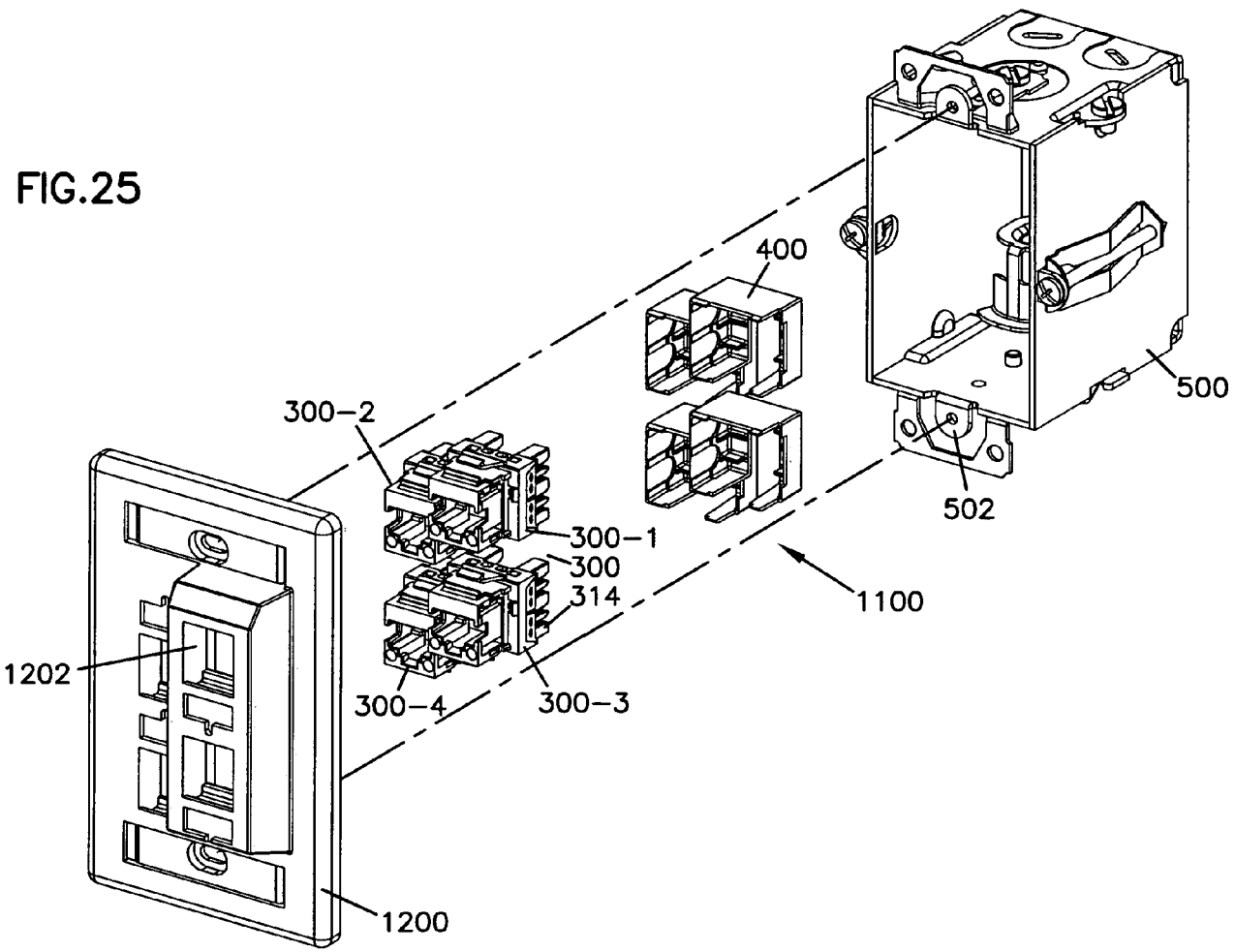
FIG. 25 is an exploded front perspective view of another embodiment of a telecommunications device having features that are examples of inventive aspects in accordance with the principles of the present disclosure.
Figure 26:
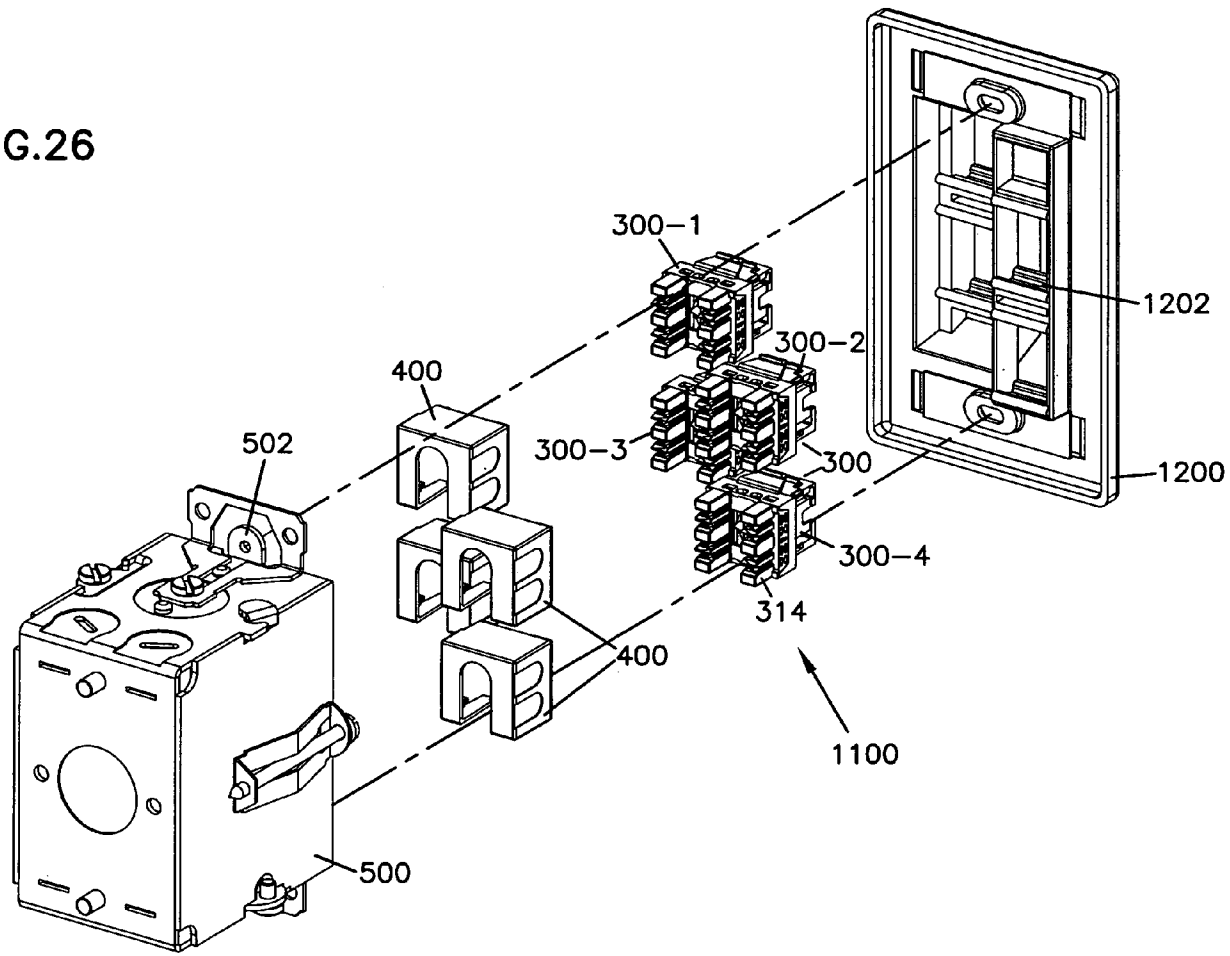
FIG. 26 is an exploded rear perspective view of the telecommunications device of FIG. 25.
Figure 28:
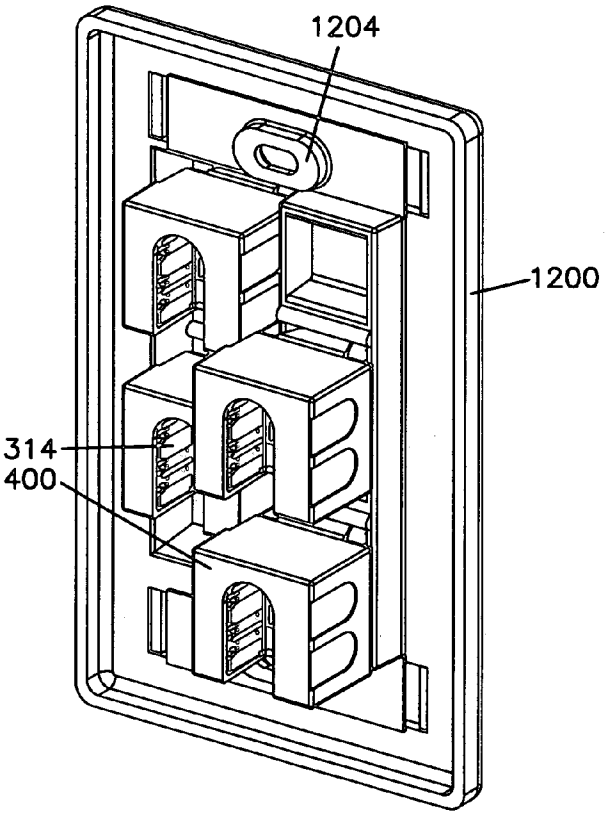
FIG. 28 is a rear perspective view of the faceplate, the jacks, and the termination caps of FIG. 27.
Figure 27:
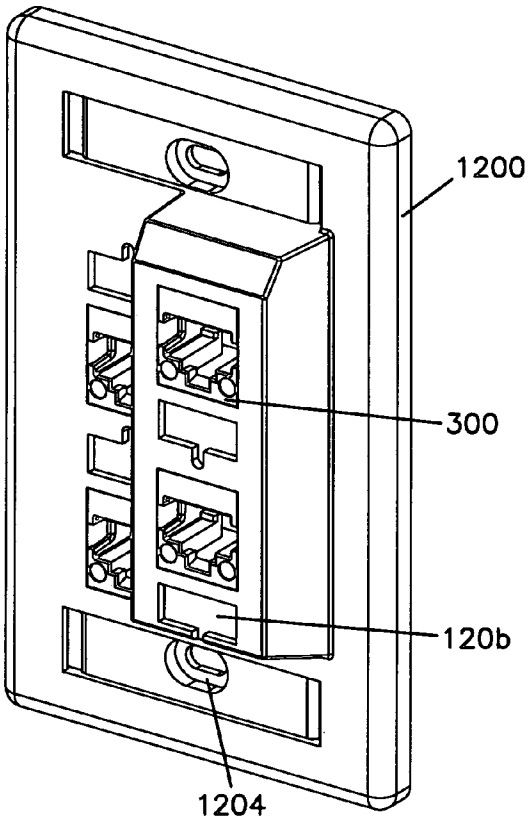
FIG. 27 is a front perspective view showing the jacks mounted on the faceplate of the telecommunications device of FIG. 25.

By offsetting the jacks 300 from each other, the conductors (i.e., spring contacts or IDC's) of the adjacent jacks 300 are moved out of alignment. FIG. 23 is a diagrammatical side view showing the arrangement of the conductors of the jacks 300 when the jacks are mounted on the faceplate 200.

As shown in FIG. 23, the jacks 300 are positioned along different horizontal planes when mounted on the faceplate 200: jack 300-1 is positioned at horizontal plane HP-1; jack 300-2 is positioned at horizontal plane HP-2; jack 300-3 is positioned at horizontal plane HP-3; and jack 300-4 is positioned at horizontal plane HP-4. For purposes of illustration, the horizontal planes HP-1, HP-2, HP-3, and HP-4 (collectively "horizontal planes HP") are shown to intersect the approximate center-points of the individual jacks 300.

The offset configuration reduces alien crosstalk by distancing the conductors of the jacks 300 farther apart than in a non-offset configuration. As shown in FIG. 23, the adjacent jacks have been vertically offset a distance Y, the distance measured, for example, between horizontal plane HP-1 and horizontal plane HP-2.

Figure 24:
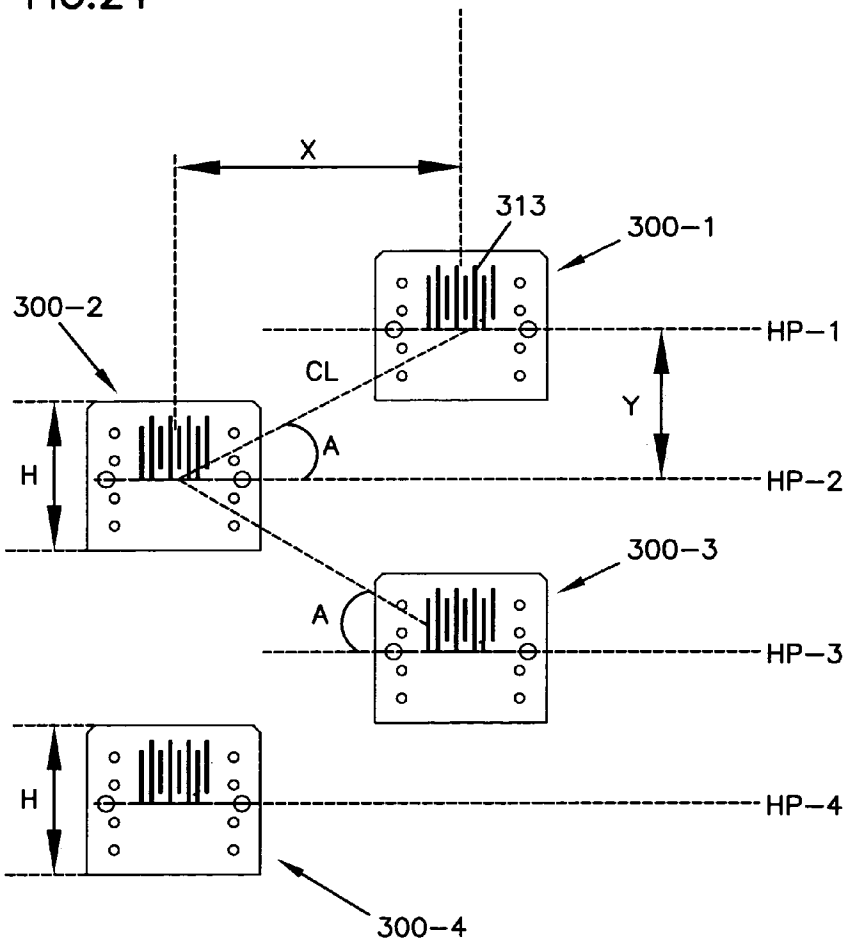
FIG. 24 is a diagrammatical front view showing the arrangement of the conductors of the jacks when the jacks are mounted on the faceplate of FIG. 20.

FIG. 24 is a diagrammatical front view showing the arrangement of the conductors of the jacks 300 when the jacks 300 are mounted on the faceplate 200. As shown in FIG. 24, to further offset two adjacent jacks 300 from one another, adjacent jacks 300 are also horizontally offset such that the jacks 300 do not share common vertical planes. For example, the jack 300-1 and/or the jack 300-2 have been shifted horizontally a distance X relative to one another.

The diagonal distance between the offset jacks 300 of the telecommunications device 100 is determined using the vertical and horizontal offset distances between the jacks 300. As shown in FIG. 24, an offset angle A is defined between the horizontal plane HP-2 of the jack 300-2 and a line CL intersecting the two jacks 300-1, 300-2 at their approximate center points. It is well known that the line CL is a greater distance than either of the distances X, Y.

The adjacent jacks 300 should preferably be offset by at least a predetermined distance such that alien crosstalk between the adjacent jacks 300 is effectively reduced. While the goal is to maximize the extent of the line CL, in one preferred embodiment the starting point is to establish a minimum predetermined distance component that is no less than approximately one-half the height H of the jack 300 (see FIG. 24). By being offset at least by one-half the height H of a jack 300, the conductors of the adjacent jacks 300 are moved far enough out of a common horizontal plane HP to effectively help minimize alien crosstalk between the adjacent jacks 300.

In some embodiments, the height H of the jack 300 is approximately 0.6 inches (15.24 mm), one-half the height H being approximately 0.3 inches (7.62 mm). Thus, for example, Y would preferably be at least approximately 0.3 inches (7.62 mm).

While it would be desirable to have a maximum horizontal displacement as well, in practice, a minimum horizontal displacement is preferably at least approximately 2 inches (50.8 mm). If the distance X is approximately 2 inches (50.8 mm) and the distance Y is approximately 0.3 inches (7.62 mm), the offset angle A between adjacent jacks 300 will be approximately 8.5 degrees and the length of line CL will be approximately 2.02 inches (51.31 mm). It should be noted that the diagonal distance CL and the offset angle A can have various other values but should be at least the approximately predetermined values to function to effectively reduce alien crosstalk.

The faceplate 200 of the telecommunications device 100 also includes designation label slots 206 for receiving designation label panels 208 (see FIG. 1). The designation label slots are positioned laterally adjacent the corresponding ports 310 of the jacks 300. The designation label slots 206 include openings 210 at the sides of the slots 206 for receiving fingers 214 of the designation label panels 208 to provide for a snap-fit configuration. The notches 212 defined at the bottom sides of the slots 206 enable the designation label panels 208 to be snapped out of the slots 206 by providing a place to exert leverage on the panels 208 to snap them out.

FIGS. 25–28 illustrate another embodiment of a telecommunications device 1100 having features that are examples of inventive aspects in accordance with the principles of the present disclosure. The telecommunications device 1100 is similar to the device 100 of FIGS. 1–7 except that telecommunications device 1100 utilizes a different faceplate.

Figure 29:
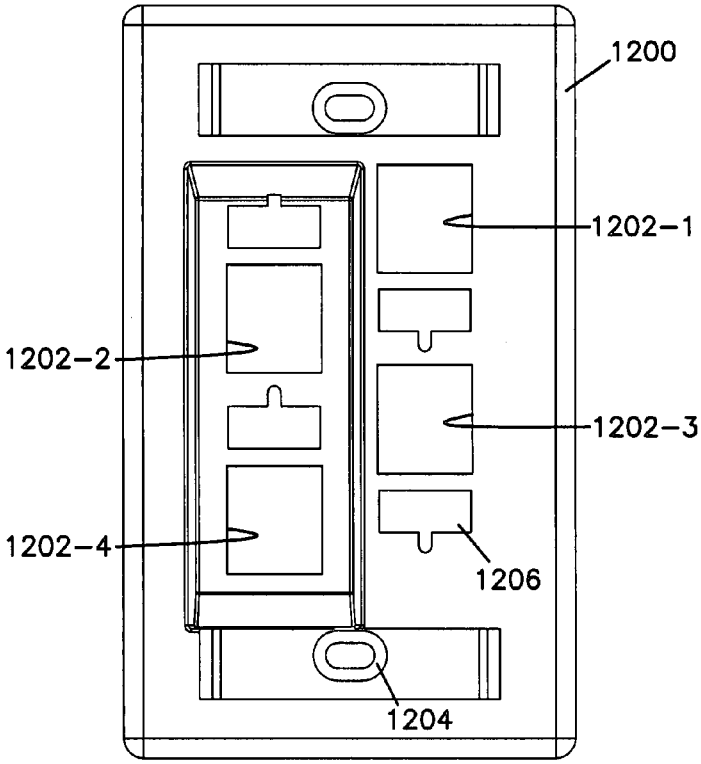
FIG. 29 is a front elevational view of a faceplate of the telecommunications device of FIG. 25.
Figure 30:
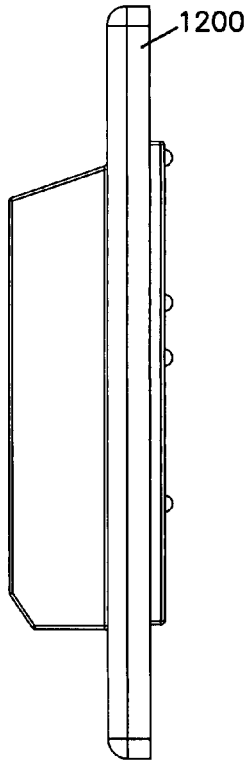
FIG. 30 is a side elevational view of the faceplate of FIG. 29.
Figure 31:
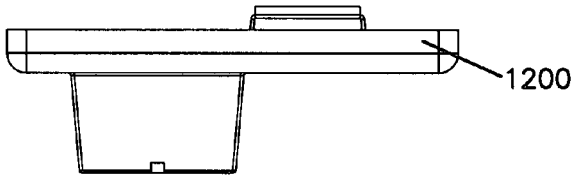
FIG. 31 is a top plan view of the faceplate of FIG. 29.

The faceplate 1200 of the device 1100 is shown in FIGS. 29–31. The faceplate 1200 includes adjacent jack receptacle pairs 1202 that are offset vertically, horizontally and also staggered in a front-to-back direction with respect to each other. This configuration further increases the distances between the conductors of two adjacent jacks as compared to that of the faceplate 200. The receptacles 1202 of the faceplate 1200 of FIGS. 29–31 are staggered at two different depths. In the faceplate 1200 shown in FIGS. 29–31, the first and the third jacks 300-1, 300-3 lie in a first plane and the second and the fourth jacks 300-2, 300-4 lie in a second plane that is at a different depth from the first plane.

Figure 32:
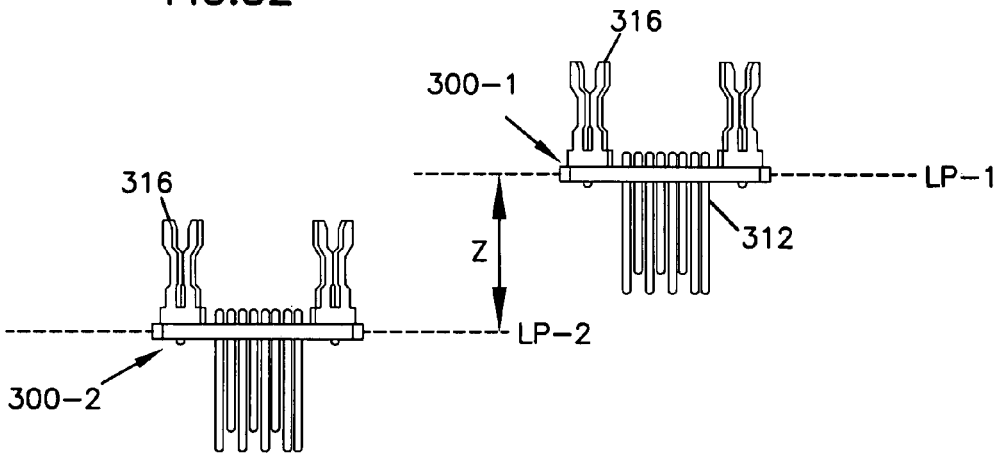
FIG. 32 is a diagrammatical top view showing the arrangement of the conductors of two adjacent jacks when the jacks are mounted on the faceplate of FIG. 29.

As diagrammatically shown in FIG. 32, jack 300-1 is positioned such that it lies within a first lateral plane LP-1 and jack 300-2 is positioned such that it lies in a second lateral plane LP-2 that is staggered from the first lateral plane LP-1. A distance Z indicates the distance that the adjacent jacks 300-1, 300-2 are staggered in relation to one another. The distance Z should be at least such that the conductors of the adjacent jacks 300 are staggered far enough from alignment to reduce alien crosstalk. Although it is preferable to stagger the adjacent jacks 300 enough to remove their IDC's and spring contacts from overlapping in a common plane, as mentioned above, a partial overlap of the conductors of adjacent jacks can still function to reduce alien crosstalk because the conductors are no longer completely within a common plane. By moving even a portion of the conductors of a particular jack 300 out of alignment with at least a portion of the conductors of an adjacent jack 300, alien crosstalk is reduced between the conductors of the respective adjacent jacks 300.

The configuration of the faceplate 1200 further separates the conductors of adjacent jacks 300 away from one another by providing a third dimension of separation. The resultant increase in distance between the staggered conductors of the adjacent jacks 300 helps further reduce alien crosstalk between adjacent jacks.

It should be noted that, although in the foregoing description of the telecommunication devices 100, 1100, terms such as "front", "back", "right", "left", "top", and "bottom" have been used for ease of description and illustration, no restriction is intended by such use of the terms.

The embodiments discussed above are provided as examples. Having described the preferred aspects and embodiments of the present invention, modifications and equivalents of the disclosed concepts may readily occur to one skilled in the art. However, it is intended that such modifications and equivalents be included within the scope of the claims which are appended hereto.

The invention claimed is:

1. A jack assembly comprising:

a first jack including a front end, a back end, a first outermost sidewall and an opposite second outermost sidewall, the first jack defining a port in the front end for receiving a plug, the first jack also defining spring contacts within the port for making electrical contact with the plug, the first jack including insulation displacement contacts projecting in a direction from the front end to the back end of the first jack, the insulation displacement contacts electrically connected to the spring contacts, the insulation displacement contacts configured to establish electrical contact with conductors of a cable, the insulation displacement contacts arranged in two columns that define a space therein-between for receiving the conductors of the cable, the insulation displacement contacts defining an outer surface;

a first cap manufactured of a material configured to minimize transmission of electrical signal away from its intended path, wherein the first cap includes an electrically non-conductive material which is impregnated with an electrically conductive material such that the first cap is overall electrically non-conductive, the first cap constructed to fit about the first jack to cover at least a portion of the outer surface defined by the insulation displacement contacts, the first cap including a back wall, a top wall, a bottom wall, a first sidewall, and a second sidewall, wherein, once mounted thereon, the first sidewall of the first cap is configured to align flush with the first outermost sidewall of the first jack, the first sidewall of the first cap including a notch that, when mounted, defines an airspace between the first sidewall of the first cap and the first outermost sidewall of the first jack; and an unshielded cable terminated to the first jack, wherein the electrically conductive material of the first cap is not grounded through the cable when the first cap is mounted on the first jack.

2. A jack assembly according to claim 1, wherein the second sidewall of the first cap extends laterally past the second outermost sidewall of the first jack.

3. A jack assembly according to claim 1, wherein the electrically conductive material impregnated into the electrically non-conductive material includes carbon.

4. A jack assembly according to claim 1, wherein the first jack is a recommended (RJ) type jack.

5. A jack assembly according to claim 1, wherein the first cap defines an opening in the back wall of the first cap generally aligned with the space defined in between the two columns of the insulation displacement contacts.

6. A jack assembly according to claim 1, wherein the first cap defines a recess on the second sidewall of the first cap.

7. A jack assembly according to claim 6, wherein the first cap defines an inner surface of the second sidewall and an outer surface of the second sidewall, wherein the first cap defines a recess on the inner surface and a recess on the outer surface of the second sidewall.

8. A jack assembly according to claim 1, further comprising a second jack adjacently positioned next to the first jack, the second jack including a second cap manufactured of a material configured to minimize transmission of electrical signal away from its intended path mounted thereon, the second cap including a first sidewall and a second sidewall, the second sidewall of the second cap including a recess that is positioned adjacent the first sidewall of the first cap, the recess on the second sidewall of the second cap defining a clearance space for accommodating ends of conductors of a cable protruding laterally from the insulation displacement contacts of the first jack.

9. A jack assembly comprising:

a first jack including a front end, a back end, a first outermost sidewall and an opposite second outermost sidewall, the first jack defining a port in the front end for receiving a plug, the first jack also defining spring contacts within the port for making electrical contact with the plug, the first jack including insulation displacement contacts projecting in a direction from the front end to the back end of the first jack, the insulation displacement contacts electrically connected to the spring contacts, the insulation displacement contacts configured to establish electrical contact with conductors of a cable, the insulation displacement contacts arranged in two columns that define a space therein-between for receiving the conductors of the cable, the insulation displacement contacts defining an outer surface; and a first cap manufactured of a material configured to minimize transmission of electrical signal away from its intended path, the first cap constructed to fit about the first jack to cover at least a portion of the outer surface defined by the insulation displacement contacts, the cap including a back wall, a top wall, a bottom wall, a first sidewall, and a second sidewall, wherein the first cap defines an inner surface of the second sidewall and an outer surface of the second sidewall, wherein the first cap includes a recess on the inner surface of the second sidewall defining a clearance space for accommodating ends of conductors of a cable protruding laterally from the insulation displacement contacts and a recess on the outer surface of the second sidewall.

10. A jack assembly according to claim 9, wherein the second sidewall of the first cap extends laterally past the second outermost sidewall of the first jack.

11. A jack assembly according to claim 9, wherein the first cap includes an electrically non-conductive material which is impregnated with an electrically conductive material such that the first cap is overall electrically non-conductive.

12. A jack assembly according to claim 11, wherein the electrically conductive material impregnated into the electrically non-conductive material includes carbon.

13. A jack assembly according to claim 9, wherein the first jack is a recommended (RJ) type jack.

14. A jack assembly according to claim 9, wherein the first cap defines an opening in the back wall of the first cap generally aligned with the space defined in between the two columns of the insulation displacement contacts.

15. A jack assembly according to claim 11, further comprising an unshielded cable terminated to the first jack, wherein the electrically conductive material of the first cap is not grounded through the cable when the first cap is mounted on the first jack.

16. A jack assembly according to claim 9 further comprising a second jack adjacently positioned next to the first jack, the second jack including a second cap manufactured of a material configured to minimize transmission of electrical signal away from its intended path mounted thereon, the second cap including a first sidewall and a second sidewall, the second sidewall of the second cap including a recess that is positioned adjacent the first sidewall of the first cap, the recess on the second sidewall of the second cap defining a clearance space for accommodating the ends of conductors of the cable protruding laterally from the insulation displacement contacts of the first jack.

17. A jack assembly comprising:

a first jack including a front end, a back end, a first outermost sidewall and an opposite second outermost sidewall, the first jack defining a port in the front end for receiving a plug, the first jack also defining spring contacts within the port for making electrical contact with the plug, the first jack including insulation displacement contacts projecting in a direction from the front end to the back end of the first jack, the insulation displacement contacts electrically connected to the spring contacts, the insulation displacement contacts configured to establish electrical contact with conductors of a cable, the insulation displacement contacts arranged in two columns that define a space therein-between for receiving the conductors of the cable, the insulation displacement contacts defining an outer surface; and a first cap manufactured of a material configured to minimize transmission of electrical signal away from its intended path, the first cap constructed to fit about the first jack to cover at least a portion of the outer surface defined by the insulation displacement contacts, the first cap including a back wall, a top wall, a bottom wall, a first sidewall, and a second sidewall, wherein, once mounted thereon, the first sidewall of the first cap is configured to align flush with the first outermost sidewall of the first jack, the first sidewall of the first cap including a notch that, when mounted, defines an airspace between the first sidewall of the first cap and the first outermost sidewall of the first jack, the first cap defining an inner surface of the second sidewall and an outer surface of the second sidewall, wherein a recess is defined on the inner surface and a recess is defined on the outer surface of the second sidewall.

18. A jack assembly comprising:

a first jack including a front end, a back end, a first outermost sidewall and an opposite second outermost sidewall, the first jack defining a port in the front end for receiving a plug, the first jack also defining spring contacts within the port for making electrical contact with the plug, the first jack including insulation displacement contacts projecting in a direction from the front end to the back end of the first jack, the insulation displacement contacts electrically connected to the spring contacts, the insulation displacement contacts configured to establish electrical contact with conductors of a cable, the insulation displacement contacts arranged in two columns that define a space therein-between for receiving the conductors of the cable, the insulation displacement contacts defining an outer surface;

a first cap manufactured of a material configured to minimize transmission of electrical signal away from its intended path, the first cap including an electrically non-conductive material which is impregnated with an electrically conductive material such that the first cap is overall electrically non-conductive, the first cap constructed to fit about the first jack to cover at least a portion of the outer surface defined by the insulation displacement contacts, the cap including a back wall, a top wall, a bottom wall, a first sidewall, and a second sidewall adjacent one of the two columns, the second sidewall including a recess defining a clearance space for accommodating ends of conductors of a cable protruding laterally from the insulation displacement contacts; and an unshielded cable terminated to the first jack, wherein the electrically conductive material of the first cap is not grounded through the cable when the first cap is mounted on the first jack.

* * * * *